US009844268B2

(12) United States Patent
DeJule

(10) Patent No.: US 9,844,268 B2
(45) Date of Patent: Dec. 19, 2017

(54) SITTING APPARATUS

(71) Applicant: Aaron DeJule, River Forest, IL (US)

(72) Inventor: Aaron DeJule, River Forest, IL (US)

( * ) Notice: Subject to any disclaimer, the term of this patent is extended or adjusted under 35 U.S.C. 154(b) by 0 days.

(21) Appl. No.: 15/071,926

(22) Filed: Mar. 16, 2016

(65) Prior Publication Data

US 2016/0331142 A1 Nov. 17, 2016

Related U.S. Application Data

(60) Provisional application No. 62/133,655, filed on Mar. 16, 2015, provisional application No. 62/143,438, filed on Apr. 6, 2015.

(51) Int. Cl.
*A47C 7/54* (2006.01)
*A47C 1/03* (2006.01)

(52) U.S. Cl.
CPC ..... *A47C 1/03* (2013.01)

(58) Field of Classification Search
CPC ..... A47C 1/03
USPC ..... 297/411.32, 411.33, 411.34, 411.35, 297/411.36, 411.37, 411.38
See application file for complete search history.

(56) References Cited

U.S. PATENT DOCUMENTS 1,706,634 A * 3/1929 Seils ..... B60N 2/4666 297/411.35 X
4,244,623 A * 1/1981 Hall ..... A47C 1/03 297/411.36 X
4,277,102 A * 7/1981 Aaras ..... A47C 1/03 297/411.36 X
4,311,338 A * 1/1982 Moorhouse ..... B60N 2/464 297/411.36 X
4,579,384 A * 4/1986 Sharod ..... B60N 2/4606 297/411.33 X
4,872,727 A * 10/1989 Rye ..... A47C 1/03 297/411.36 X
5,029,941 A * 7/1991 Twisselmann ..... A61B 90/60 297/411.38 X
5,143,422 A * 9/1992 Althofer ..... A47C 1/03 297/411.36 X
5,242,138 A * 9/1993 Kornberg ..... A61G 5/12 297/411.38 X
5,281,001 A * 1/1994 Bergsten ..... A47B 21/0371 297/411.35 X
5,369,805 A * 12/1994 Bergsten ..... A47B 21/0371 297/411.35 X
5,407,249 A * 4/1995 Bonutti ..... A47B 21/0371 297/411.35 X (Continued)

FOREIGN PATENT DOCUMENTS

DE WO 9307782 A1 * 4/1993 ..... A47C 1/03

*Primary Examiner* — Rodney B White
(74) *Attorney, Agent, or Firm* — Wood, Phillips, Katz, Clark & Mortimer

(57) ABSTRACT

A sitting apparatus having a frame configured to be situated at a sitting location. A seat assembly on the frame defines a support for a user in a sitting position. At least one armrest assembly has at least one surface to support an arm of a user in a sitting position on the seat assembly. The at least one armrest assembly is configured to be changed between first and second states. The at least one surface changes in angular relationship to a horizontal reference plane as an incident of the at least one armrest assembly changing between the first and second states.

21 Claims, 12 Drawing Sheets

(56) References Cited

U.S. PATENT DOCUMENTS 5,636,899 A * 6/1997 Schiff ..... B60N 2/464 297/411.36 X
5,647,638 A * 7/1997 Ritt ..... A47C 1/03 297/411.36 X
5,676,483 A * 10/1997 Koubek ..... A47C 1/03 297/411.36
5,848,823 A * 12/1998 Su ..... A47C 1/03 297/411.35
5,884,975 A * 3/1999 Su ..... A47C 1/03 297/411.35
5,893,607 A * 4/1999 Trimnell ..... A47C 7/70 297/411.37 X
5,908,221 A * 6/1999 Neil ..... A47C 1/03 297/411.36
5,927,815 A * 7/1999 Nakamura ..... F16C 11/106 297/411.38 X
5,971,484 A * 10/1999 Lamart ..... A47C 1/03 297/411.35 X
5,984,408 A * 11/1999 Bujaryn ..... A47C 1/03 297/411.37 X
6,460,932 B1 * 10/2002 Kopish ..... A47C 1/03 297/411.35 X
6,540,300 B2 * 4/2003 Piretti ..... A47C 1/03 297/411.35
6,588,847 B2 * 7/2003 Murakami ..... A47C 1/03 297/411.37 X
7,055,910 B2 * 6/2006 Wright ..... A61F 5/3761 297/411.35 X
7,150,504 B1 * 12/2006 Lee ..... A47C 1/03 297/411.35
7,159,947 B1 * 1/2007 Lee ..... A47C 1/03 297/411.35
7,475,946 B2 * 1/2009 Diffrient ..... A47C 1/03 297/411.33
7,537,268 B2 * 5/2009 Becker ..... B60N 2/0232 297/411.35 X
7,677,654 B2 * 3/2010 Enberg ..... B60N 2/4606 297/411.35 X
7,726,745 B2 * 6/2010 Bruns ..... A47C 7/54 297/411.36
7,862,123 B2 * 1/2011 Baker ..... A47C 7/54 297/411.35 X
8,070,233 B2 * 12/2011 Schumacher ..... B60N 2/3047 297/411.32 X
8,840,188 B2 * 9/2014 Diffrient ..... A47C 1/03 297/411.37 X
8,967,724 B2 * 3/2015 Battey ..... A47C 1/032 297/411.35
9,028,001 B2 * 5/2015 Battey ..... A47C 1/032 297/411.35
9,044,098 B2 * 6/2015 Bauer ..... A47C 7/54
9,427,085 B2 * 8/2016 Battey ..... A47C 1/032
2002/0109387 A1 * 8/2002 Noiseux ..... A47C 1/03 297/411.35 X
2003/0042782 A1 * 3/2003 Davis ..... A47C 7/54 297/411.35
2004/0245835 A1 * 12/2004 Diffrient ..... A47C 1/03 297/411.37
2005/0012376 A1 * 1/2005 Siminovitch ..... A47C 7/54 297/411.35
2005/0200186 A1 * 9/2005 Schumacher ..... B60N 2/3047 297/411.38
2005/0275271 A1 * 12/2005 Magnuson ..... B60N 2/46 297/411.38
2006/0006723 A1 * 1/2006 Diffrient ..... A47C 1/03 297/411.35
2006/0202541 A1 * 9/2006 Armo ..... B60N 2/4633 297/411.35
2009/0033139 A1 * 2/2009 Machael ..... A47C 1/03 297/411.37
2011/0049960 A1 * 3/2011 Ferguson ..... B64C 11/065 297/411.38
2011/0181090 A1 * 7/2011 Chen ..... A47C 1/03 297/411.37
2014/0077566 A1 * 3/2014 Battey ..... A47C 1/032 297/411.36
2014/0145490 A1 * 5/2014 Chen ..... A47C 1/03 297/411.37
2015/0028645 A1 * 1/2015 Baas ..... A47C 7/54 297/411.38
2015/0102641 A1 * 4/2015 Mendicino ..... B60N 2/468 297/411.38 X
2015/0298587 A1 * 10/2015 Machael ..... B60N 2/4633 297/411.38

* cited by examiner $50^{18'}$
$48^{18'}$
$46^{18'}$
$22^{18'}$
50
$20^{18'}$
146
$30^{18'}$
148
$44^{18'}$
$120^{14'}$
$50^{14'}$
$22^{14'}$
126
$20^{14'}$
$48^{14'}$
$46^{14'}$
132
$44^{14'}$
130

SITTING APPARATUS

BACKGROUND OF THE INVENTION

Field of the Invention

This invention relates to sitting apparatus and, more particularly, to a sitting apparatus having at least one armrest assembly upon which a user in a sitting position can support his/her arm.

Background Art

There are currently many different types of sitting apparatus that incorporate an armrest assembly to allow a user in a sitting position thereon to support his/her arm(s). The sitting apparatus with the arm supports may be in the form of a task chair, a lounger, etc. The sitting apparatus may be floor mounted, wall mounted, or even ceiling mounted. For simplicity, the basic function and deficiencies of existing armrest assemblies will be described with respect to a conventional task chair, with it being understood that the design criteria and objectives are the same for basically all types of sitting apparatus that incorporate one or more armrest assemblies.

The conventional task chair has a frame with a wheeled pedestal upon which a seat assembly is supported. The chair may be provided with or without a backrest assembly. Laterally spaced armrest assemblies are provided at the sides of the seat assembly. Each armrest assembly has a surface to support the elbow and forearm regions of a user in a sitting position on the seat assembly. Typically, the surface on each armrest assembly is nominally flat with a reference plane thereon generally parallel to a subjacent support surface. The armrest assemblies are constructed so that the respective surfaces thereon can be raised and lowered to accommodate a particular user size and/or to assist the performance of different tasks. Normally, the surfaces are also movable selectively towards and away from each other and each may be repositionable around a vertically extending axis.

More and more, users utilize laptop computers, tablets, PDAs, etc, while sitting in this type of chair. Generally, the user will hold the particular device with both hands while supporting the elbow and/or forearm regions on the spaced surfaces on the armrest assemblies.

The horizontal orientation of the armrest assembly surfaces does not result in the particular device being optimally positioned with the user's forearms and/or elbows supported thereon. Consequently, the user will generally exercise one of three options with this conventional chair construction.

The first option is to simply observe the screen/monitor of the device from a somewhat awkward angle. This can eventually lead to eye strain and generally detracts from an otherwise potentially enjoyable activity.

The second option is for the user to lift his/her arms off of the armrest assemblies to place the particular device in a better location in terms of allowing easier observation of the screen/monitor and facilitating operation of the device as through a touch screen or keyboard. When the latter option is exercised, the armrest assemblies essentially become functionless other than to provide a resting place for a user periodically after his/her arms become fatigued.

The third option is to rest only the elbows on the armrest assembly surfaces. This requires hinging of each hand at the wrist and each forearm at the elbow to optimize a viewing angle. This can become fatiguing in a short period of time since the wrists and forearms remain unsupported and may be placed at awkward angles.

If the user wishes to have the benefit of an inclined backrest, the above problems may be aggravated since the user becomes further distanced from the held device and is placed at an even more inconvenient angle with respect thereto from the standpoint of both viewing and operation thereof.

In spite of the ever increasing use of laptop computers, tablets, smart phones, and other screen based technology, the industry has offered users thereof no reasonable alternative to basic task chair designs to facilitate use of that technology in a sitting position.

SUMMARY OF THE INVENTION

In one form, the invention is directed to a sitting apparatus including: a frame configured to be situated at a sitting location; a seat assembly on the frame defining a support for a user in a sitting position; and at least one armrest assembly having at least one surface to support an arm of a user in a sitting position on the seat assembly. The at least one armrest assembly is configured to be changed between first and second states. The at least one surface changes in angular relationship to a horizontal reference plane as an incident of the at least one armrest assembly changing between the first and second states.

In one form, the sitting apparatus has a front and rear and laterally spaced sides. A lateral inclination of the at least one surface changes as the at least one armrest assembly is changed between the first and second states.

In one form, the sitting apparatus has a front and rear and laterally spaced sides. A front-to-rear inclination of the at least one surface changes as the at least one armrest assembly changes between the first and second states.

In one form, the armrest assembly is configured so that the at least one surface follows movement of a part of the at least one armrest assembly that pivots around a laterally extending axis as the at least one armrest assembly is changed between the first and second states.

In one form, the laterally extending axis is located at least approximately where one of: a) a shoulder joint; and b) an elbow joint of a user in the sitting position is located.

In one form, the laterally extending axis extends through, or is adjacent to, the part of the at least one armrest assembly.

In one form, the at least one surface follows movement of a part of the at least one armrest assembly as the at least one armrest assembly is changed between the first and second states. The part of the at least one armrest assembly is connected to the frame through a mechanical linkage.

In one form, the part of the at least one armrest assembly defines a link member in the mechanical linkage.

In one form, the mechanical linkage has a projected pivot located at least approximately where one of: a) a shoulder joint; and b) an elbow joint of a user in the sitting position is located.

In one form, the sitting apparatus further includes a locking assembly that is operable to selectively maintain the at least one armrest assembly in at least one of the first and second states.

In one form, the locking assembly has an actuator that is configured to be moved by a user. The actuator consists of at least one of: a) a component that is movable independently of the at least one surface on the at least one armrest assembly; and b) a part of the at least one armrest assembly that moves with the at least one surface as the at least one armrest assembly is changed between the first and second states.

In one form, the at least one armrest assembly has first and second laterally spaced armrest assemblies.

In one form, the first and second armrest assemblies are configured so that the at least one surface on the first and second armrest assemblies can be relatively moved to change a lateral spacing between the at least one surface on the first and second armrest assemblies.

In one form, the first and second armrest assemblies are configured so that the at least one surface on each of the first and second armrest assemblies can be selectively raised and lowered relative to the frame.

In one form, the first and second armrest assemblies are configured so that the at least one surface on each of the first and second armrest assemblies can be selectively moved around a respective vertically extending axis.

In one form, the sitting apparatus further includes a backrest that is configured to be moved relative to the frame so as to thereby change an angular orientation of the backrest relative to the frame.

In one form, the sitting apparatus further includes a wheeled support for the frame.

In one form, the at least one armrest assembly has first and second riser components that are configured to be placed in different vertical relationship to thereby change the at least one armrest assembly between the first and second states.

In one form, at least one of the first and second riser components is mounted to a part of the at least one armrest assembly that moves with the at least one surface for pivoting movement around an axis.

In one form, each of the first and second riser components is mounted to a part of the at least one armrest assembly that moves with the at least one surface for pivoting movement around a respective axis.

DETAILED DESCRIPTION OF THE PREFERRED EMBODIMENT

Figure 1:
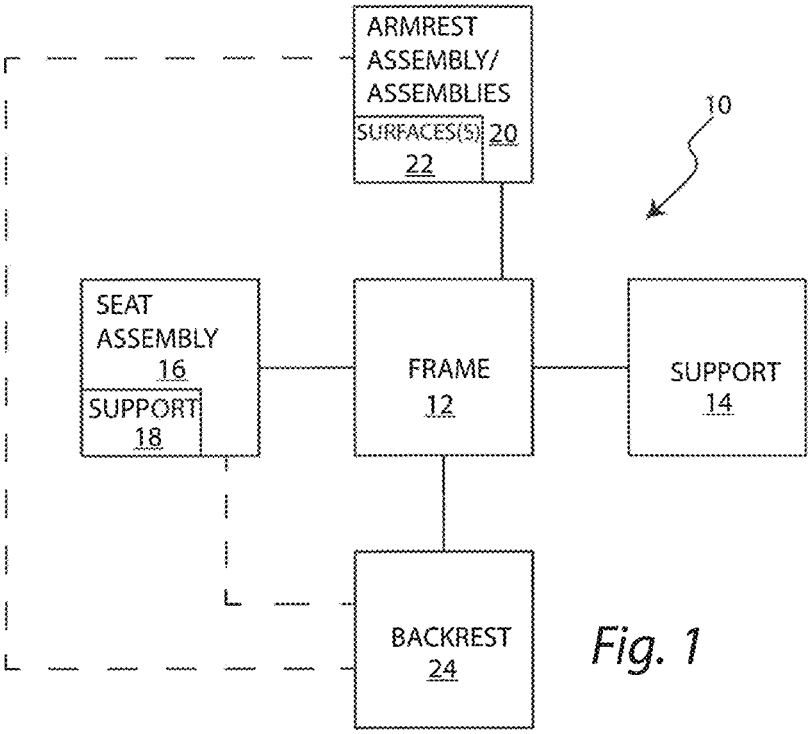
FIG. 1 is a schematic representation of one form of sitting apparatus, according to the present invention, and including at least one armrest assembly with at least one arm supporting surface thereon for a user in a sitting position.

In FIG. 1, a sitting apparatus, according to the present invention, is shown in schematic form at 10. The sitting apparatus 10 consists of a frame 12 configured to be situated relative to a support 14 at a sitting location. The support 14 may be any type of support commonly used for sitting apparatus—including a subjacent surface upon which the frame 12 can be placed, a vertically extending structure upon which the frame 12 is mounted, an overhead structure from which the frame 12 is suspended, etc.

A seat assembly 16 is situated on the frame 12 and defines a support 18 for a user in a sitting position.

At least one armrest assembly 20 has at least one surface 22 to support an arm of a user in a sitting position on the seat assembly 16. While typically two such armrest assemblies 20 are incorporated, it is possible that a single armrest assembly 20 might be provided on one side of the seat assembly 16 or in a more laterally centered position.

The at least one armrest assembly 20 is configured to be changed between first and second states. The at least one surface 22 is changed in angular relationship to a horizontal reference plane as an incident of the at least one armrest assembly changing between the first and second states.

The sitting apparatus 10 may further include a backrest 24 that is configured to be moved relative to the frame 12 so as to thereby change an angular orientation of the backrest 24 relative to the frame 12.

The seat assembly 16 may have a fixed orientation or may be adjustable relative to the frame 12. The backrest 24 may be mounted to the frame 12 independently of the seat assembly 16. Alternatively, as shown in dotted lines in FIG. 1, the backrest 24 and seat assembly 16 may be interconnected so that the seat assembly 16 and backrest 24 move in a coordinated manner.

As also shown in dotted lines in FIG. 1, the backrest 24 may be interconnected to the at least one armrest assembly 20 so that changing of the angular position of the backrest 24 effects a predetermined movement of the at least one armrest assembly 20 to thereby reorient the surface(s) 22 thereon.

The schematic showing of the components in FIG. 1 is intended to encompass specific components as described in exemplary embodiments hereinbelow, and virtually an unlimited number of variations in those components and their interaction that would be obvious to one skilled in the art with the teachings herein in hand.

Figure 2:
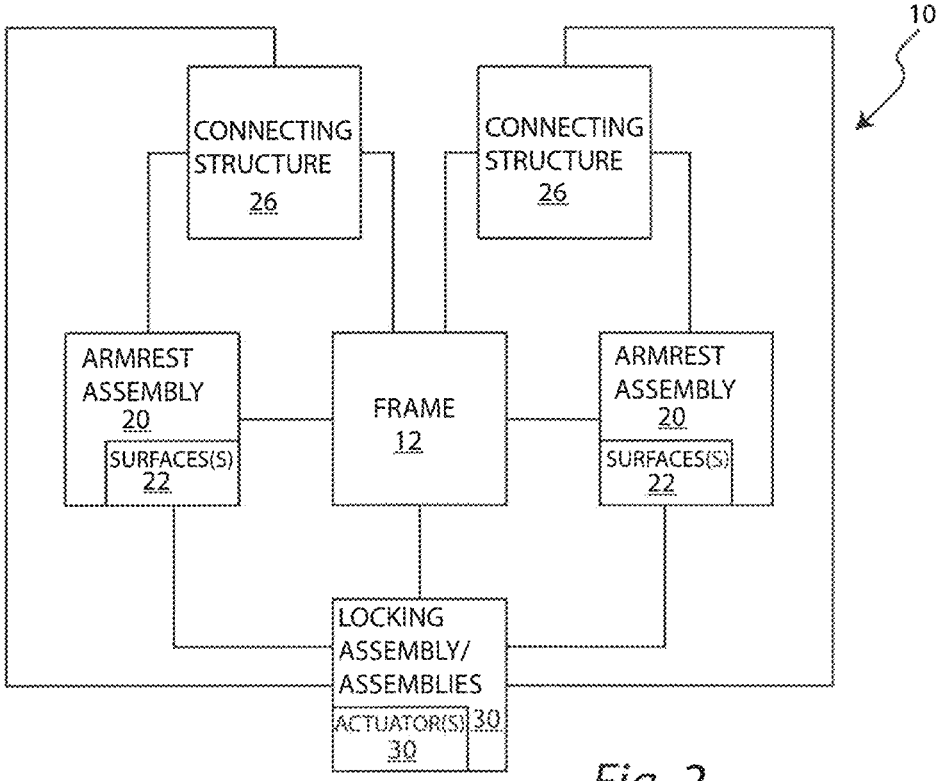
FIG. 2 is a schematic representation showing additional details for the inventive sitting apparatus in FIG. 1.

Generally, as shown also in schematic form in FIG. 2, the sitting apparatus 10, in a form with separate and laterally spaced armrest assemblies 20 on the frame 12, utilizes an armrest assembly construction and connecting structure 26 between each armrest assembly 20 and frame 12 that allows each of the surfaces 22 to be moved relative to each other and the frame 12 in multiple dimensions. While in its most basic form, only a single change in angular orientation of the surfaces 22 relative to a horizontal reference plane might be allowed, as through a front-to-rear change in inclination, in other preferred forms, the surfaces 22 thereon are at least one of: a) movable towards and away from each other in a lateral direction; b) movable vertically relative to the frame 12; c) angularly repositioned around a fore-and-aft axis; and d) movable around a vertically extending axis. The primary movement of the armrest assembly surfaces 22 that is desired is relative to the frame 12 in a manner that front-to-rear inclination of the surfaces 22 changes as the armrest assemblies are changed between the aforementioned first and second states.

Figure 3:
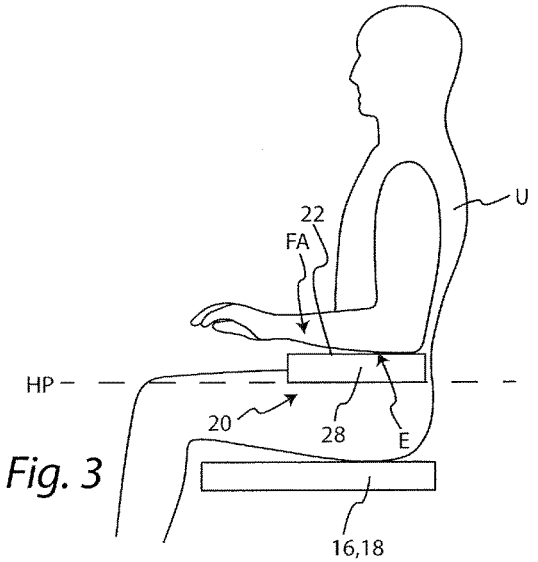
FIG. 3 is a partially schematic, side elevation view of a user in a sitting position on the inventive sitting apparatus and with the user's forearm supported on the surface of the armrest assembly with the armrest assembly in a first state.
Figure 4:
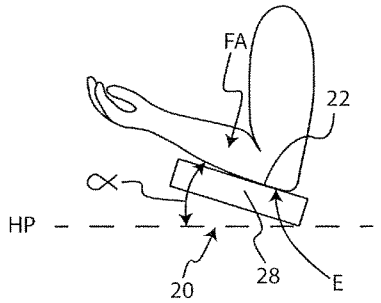
FIG. 4 is a view corresponding to that in FIG. 3 with the armrest assembly changed to a second state.

As seen in FIGS. 3 and 4, this primary desired movement of the surfaces 22 on the armrest assemblies 20 involves repositioning at least a part 28 of each armrest assembly 20, that defines its respective surface(s) 22. For simplicity, each armrest assembly 20 will be described with a single surface 22. In the first state for the representative armrest assembly 20, as shown in FIG. 3, the surface 22, while potentially contoured, approximates a flat support surface that is substantially parallel to a horizontal reference plane HP. As shown in FIG. 4, in the second state for the armrest assembly 20, the surface 22 is at an angle $\alpha$ to the horizontal plane HP with the front of the surface 22 inclined relative to the rear thereof.

Different angles $\alpha$ may be selectively settable. It is conceivable that the angle $\alpha$ may be as great as 75° or more.

As can be seen in FIGS. 3 and 4, the surface 22 will generally support primarily forearm and elbow regions FA, E on a user U with the user U in a sitting position on the seat assembly 16/support 18.

The schematic showing of the inventive structure is intended to encompass a wide range of different capabilities. For example, in one form, the armrest assembly surfaces 22 are movable only as in FIGS. 3 and 4. This movement may be effected either by manually grasping the parts 28 to effect movement thereof or, more preferably, simply by causing movement in response to movement of the user's forearm region and/or in response to other weight shift and/or force application by the user. The position of the armrest assembly surfaces may be maintained by forces applied by the user or may be mechanically fixed by appropriate structure, as described below.

In one preferred form, the various dimensions of movement of the surfaces 22—lateral and front-to-rear inclination around front-to-rear and laterally extending axes respectively, movement towards and away from each other, vertical movement, etc.—may be effected in one fluid motion by reason of the adjustment of the user's body to which the sitting apparatus 10 automatically responds. The various dimensions of movement may alternatively be effected through automated mechanisms or manually by separate manipulation of the parts, with the different configurations maintained automatically, or through one or more separate locking assemblies as shown generically at 30 in FIG. 2. Each locking assembly 30 may be operable through one or more actuators 32. The locking assemblies 30 can be used to maintain one or both of the aforementioned first and second states or other states resulting from repositioning of the surfaces 22 relative to the frame 12.

Figure 5:
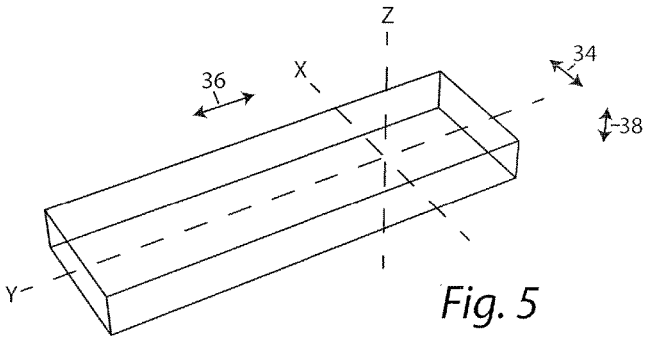
FIG. 5 is a schematic representation of a 3-axis reference system for describing the inventive structure.

For purposes of the description hereinbelow, a reference system as shown in FIG. 5 will be utilized. A three axis reference arrangement is shown with the X axis extending laterally in the direction of the double-headed arrow 34, the Y axis extending in a front-to-rear direction, as indicated by the double-headed arrow 36, and a Z axis extending in the vertical direction, as indicated by the double-headed arrow 38.

Figure 6:
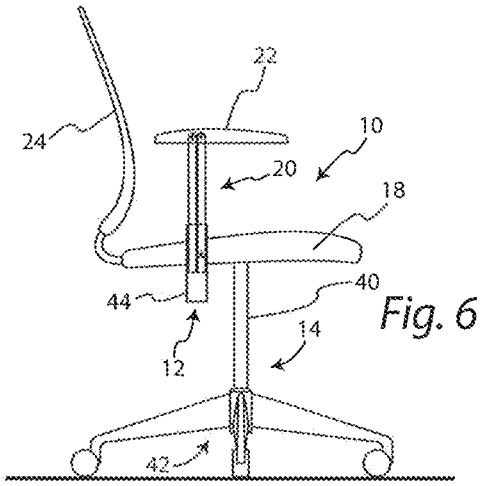
FIG. 6 is a side elevation view of one exemplary form of sitting apparatus with one exemplary form of armrest assembly incorporated therein.

Referring to FIG. 6, one more specific exemplary form of sitting apparatus 10 is shown. The support 14 is in the form of a pedestal 40 projecting upwardly from a wheeled carriage 42. The seat assembly support 18 is located at the top of the support 14. The support 18 may be at a fixed vertical height or may be vertically adjustable relative to the support 14.

A backrest 24 is connected to the support 18.

The frame 12 includes a fixed base 44 at one side of the frame 12 through which the exemplary armrest assembly 20 is operatively mounted. In this embodiment, like armrest assemblies 20 are provided at each side of the sitting apparatus 10.

Figure 7:
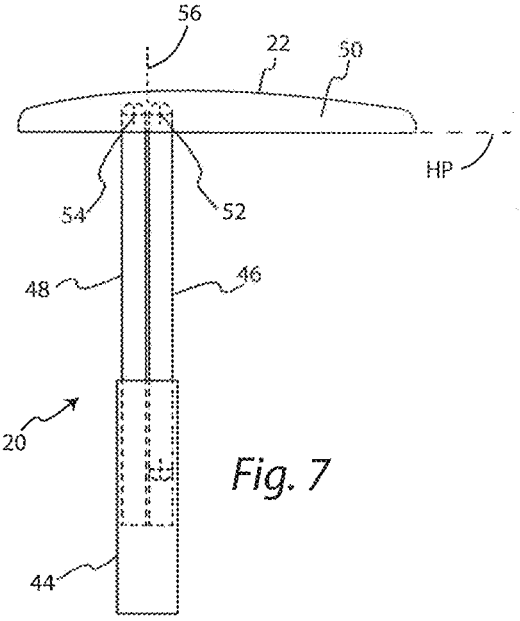
FIG. 7 is an enlarged, side elevation view of the armrest assembly in FIG. 6 in its first state.
Figure 8:
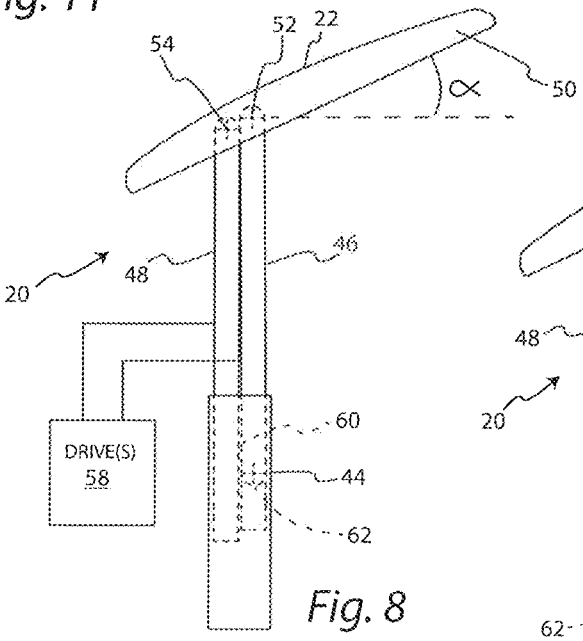
FIG. 8 is a view as in FIG. 7 with the armrest assembly in its second state.
Figure 9:
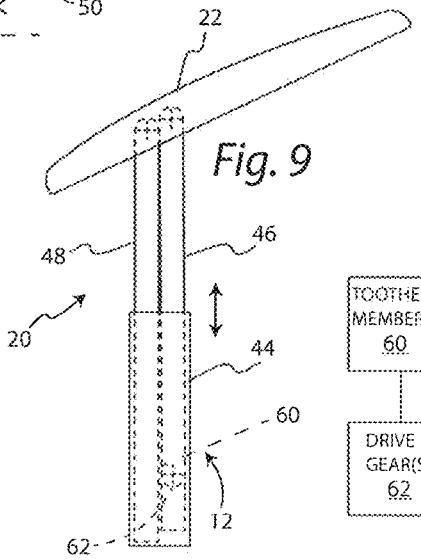
FIG. 9 is a view as in FIG. 8 with the surface on the armrest assembly lowered.

Details of one exemplary armrest assembly 20 are shown in FIGS. 7-9. In this embodiment, the armrest assembly 20 has first and second riser components 46, 48 that are configured to be placed in different vertical relationships to thereby change the armrest assembly 20 between its first state, as shown in FIG. 7, and its second state, as shown in FIG. 8. As noted above, in the first state, the surface 22, approximated as a generally flat surface, resides in a plane that is substantially parallel to the horizontal reference plane HP. In the second state, as shown in FIG. 8, the surface 22 is angled in relationship to the horizontal reference plane HP. In this case, the surface 22 makes an angle $\alpha$ with respect to the horizontal reference plane HP.

The riser components 46, 48 are substantially straight and may be abutted to each other, in which relationship they can slide vertically together guidingly within the frame base 44 and relative to each other in the vertical direction—along the Z axis.

The upper ends of the riser components 46, 48 are respectively joined to a part 50 of the armrest assembly 20, defining the surface 22, for pivoting movement about axes 52, 54, respectively. The axes 52, 54 extend laterally parallel to the X axis.

With the armrest assembly 20 in its first state, the axes 52, 54 are at the same height, as seen in FIG. 7. By advancing the first riser component 46 upwardly relative to the second riser component 48 and/or the second riser component 48 downwardly relative to the first riser component 46, the relationship in FIG. 8 is realized wherein the riser components 46, 48 and part 50 cooperate to incline the surface 22 from rear to front.

The riser components 46, 48 are also movable together guidingly within the base 44 in a vertical direction to change the height of the surface 22 relative to the frame 12 with the armrest assembly 20 in either its first or second states, as shown in FIG. 9.

The riser components 46, 48 also cooperate with the frame base 44 to be guided together in movement around a vertical axis 56. This allows the fore-and-aft length of the part 50 to be selectively either aligned with the Y axis or angled with respect thereto.

FIG. 8 discloses a generic form of a drive or drives 58 that are configured to effect relative movement between the riser components 46, 48 and base 44 to allow the armrest assembly 20 to be moved relative to the frame 12 in the various manners described above. The drive(s) 58 could be automated or simply respond to different weight shifting and movements of the user's limbs.

Figure 10:
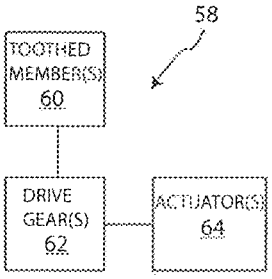
FIG. 10 is a schematic representation of a drive for changing the state of the inventive armrest assembly.

In one exemplary form, as shown additionally in schematic form in FIG. 10, the drive 58 consists of one or more toothed members 60 that cooperate with one or more drive gears 62. One or more toothed members 60 can be associated with the frame 12 and/or components making up the armrest assembly 20. One or more drive gears 62 effect appropriate movement of the toothed member(s) 60 to change the state of the armrest assembly 20 and cause the other movements of the surface 22, as described above.

The drive gear(s) 62 can be moved through an appropriate actuator 64. The change of state may be accomplished automatically in response to operation of the actuator 64 and/or may result from a shifting of the user's limbs and weight.

In the embodiment shown in FIGS. 7-9, one toothed member is shown on the riser component 48 which cooperates with a drive gear 62 that is on the riser component 46 and turned to effect relative vertical movement between the riser components 46, 48.

The generic showing of the drive 58 in FIG. 8 is intended to encompass virtually an unlimited number of other drive transmission structures/mechanisms, including crank-and-slot arrangements, screw gear arrangements, rack-and-pinion arrangements, etc.

As noted above, a particular configuration of the sitting apparatus 10, including the armrest assemblies 20, can be maintained by forces applied by a user. The aforementioned locking assemblies 30 can be utilized to maintain any desired state of the armrest assemblies 20, including the first and second states described above.

Figure 11:
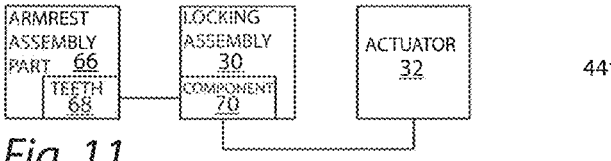
FIG. 11 is a schematic representation of an armrest assembly as in FIG. 10 with a locking assembly thereon and an associated actuator therefor.

In one exemplary form, shown schematically in FIG. 11 with a part 66 of the armrest assembly having teeth 68, as on the member 60 in FIG. 10, the locking assembly 30 may have a component 70 that is moved between adjacent teeth 68 with the locking assembly in a locked state. Disengagement of the components 70 from between the teeth 68 places the locking assembly in an unlocked state. Repositioning of the components 70 can be effected directly or indirectly through the aforementioned actuator 32, that may be a dedicated component. Alternatively, movement of another component, such as the part 50, as described below, may effect changing of the locking assembly 30 between locked and unlocked states. In that event, the part 50 serves as the actuator 32.

The component 70 may be movable through a pivoting action, through translation, or in another manner to effect changing of the state of the locking assembly 30.

It is not necessary that the component 70 interact with existing components, as a dedicated locking structure might be incorporated as an alternative.

A number of different embodiments are described below. Corresponding parts on the various embodiments will be identified with the same reference numerals and differentiated with different "'" designations.

Figure 12:
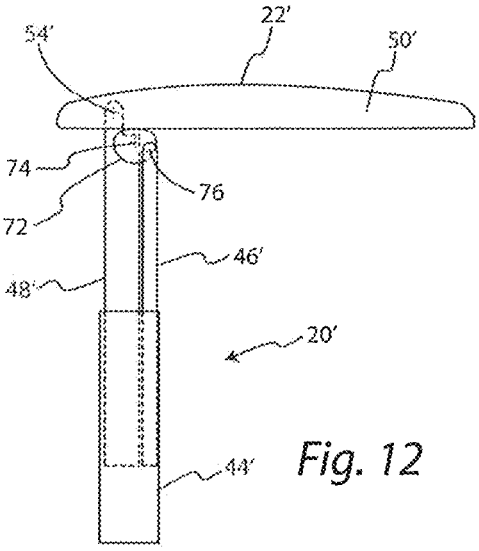
FIGS. 12 and 13 are side elevation views of a modified form of armrest assembly in first and second states, respectively.
Figure 13:
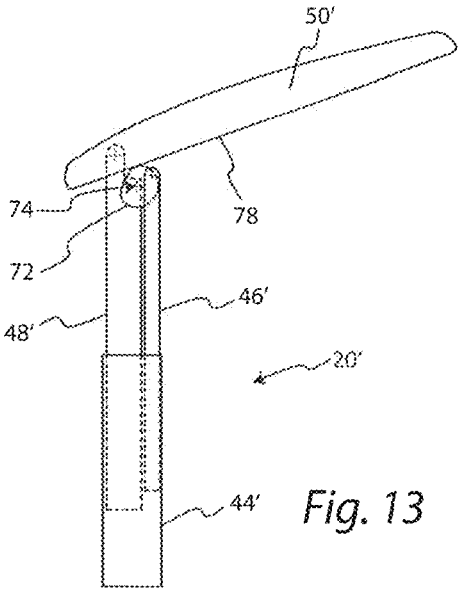

In FIGS. 12 and 13, one modified form of armrest assembly is shown at 20'. The armrest assembly 20' has riser components 46', 48' that cooperate with a fixed frame base 44'.

The part 50', defining the surface 22', is connected to the riser component 48' for pivoting movement relative thereto around a laterally extending axis 54'.

A cam component 72 is mounted to the riser component 48' for pivoting movement around a laterally extending axis 74. The cam component 72 is also connected to the riser component 46' for pivoting movement about a laterally extending axis 76 that is offset from the axis 74.

Upward movement of the riser component 46' within the frame base 44' and relative to the riser component 48' causes the cam component 72 to act against an underside surface 78 of the part 50' forwardly of the axis 54', thereby causing pivoting of the part 50' around the axis 54' between the position shown in FIG. 12 and that in FIG. 13. This corresponds to a change between first and second states for the previously described armrest assembly 20.

Figure 14:
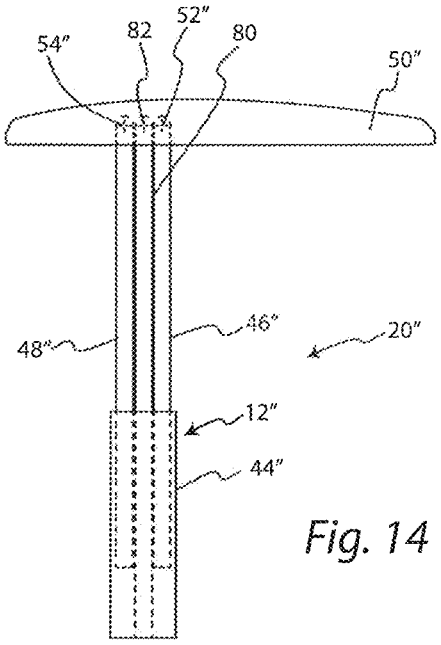
FIGS. 14 and 15 are side elevation views of another modified form of armrest assembly in first and second states, respectively.
Figure 15:
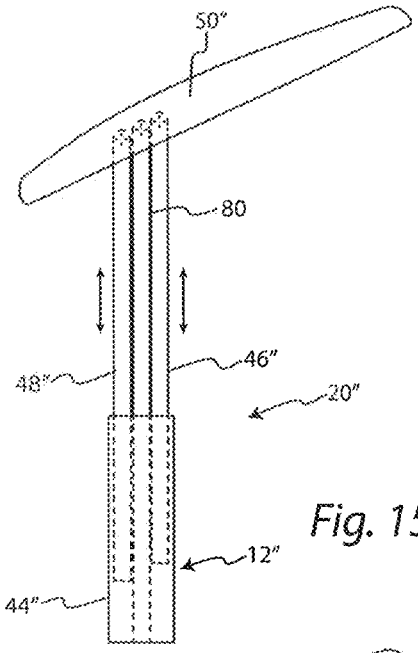

In FIGS. 14 and 15, a further variation of the inventive armrest assembly is shown at 20" with riser components 46", 48" between which a third riser component 80 is provided that is in a fixed position relative to the frame 12". The riser components 46", 48", 80 cooperate with a fixed frame base 44".

The upper ends of the riser components 46", 48" each is pivotally connected to the part 50" for relative movement around laterally extending axes 52", 54", respectively. The upper end of the riser component 80 is connected to the part 50" for pivoting movement around a laterally extending axis 82, that is between the axes 52", 54". As depicted, the axes 52", 54", 80 reside in a common plane.

The lower region of the riser component 80 is fixed to the frame base 44". As the riser components 46", 48" are moved up and down relative to each other and the riser component 80, the part 50" pivots about the axis 82 whereby the part 50" is changed between the positions shown in FIG. 14 and FIG. 15. The FIG. 14 state for the armrest assembly 20" corresponds to the first state for the armrest assemblies 20, 20', previously described, with the state of the armrest assembly 20" in FIG. 15 corresponding to the second state for the armrest assemblies 20, 20'.

Figure 16:
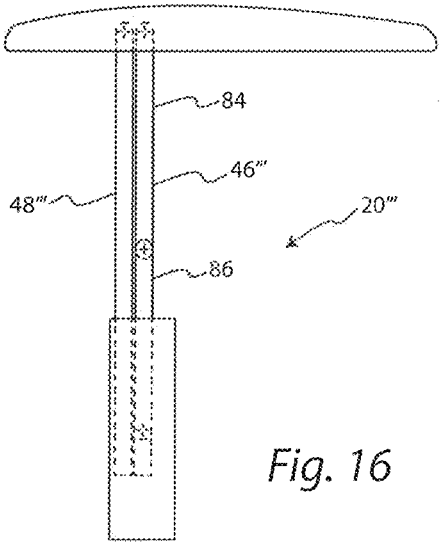
FIGS. 16 and 17 are side elevations views of a further modified form of armrest assembly in first and second states, respectively.
Figure 17:
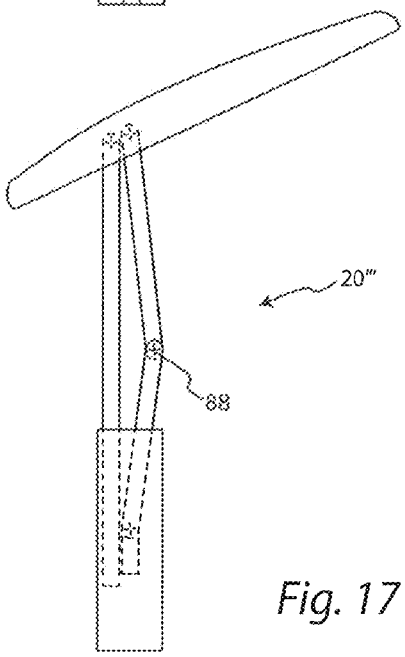

In FIGS. 16 and 17, a further modified form of armrest assembly is shown at 20'''. The primary difference between the armrest assemblies 20, 20''' is that the riser component 46''' is made from two pieces 84, 86 with adjacent ends joined for pivoting movement around a laterally extending axis 88.

As the armrest assembly 20''' is changed from a first state into a second state, corresponding to those shown for the armrest assembly 20, by upward movement of the riser component 46''' relative to the riser component 48''', the riser component pieces 84, 86 pivot, as shown in FIG. 17, thereby avoiding any friction or binding that might interfere with the transition of states. The operation of the armrest assembly 20''' is otherwise the same as that for the armrest assembly 20.

Figure 18:
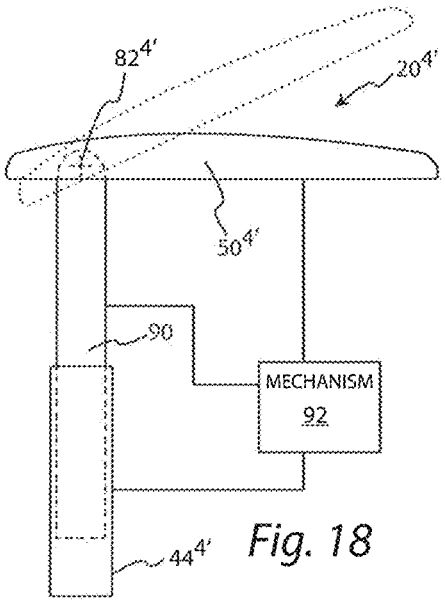
FIG. 18 is side elevation view of an armrest assembly and schematically showing a mechanism for effecting repositioning of the arm supporting surface thereon.

In FIG. 18, a further modified form of armrest assembly is shown at $\mathbf{20}^{4'}$. The armrest $\mathbf{20}^{4'}$ has a single riser component 90 that cooperates with a fixed frame base $\mathbf{44}^{4'}$. An upper region of the riser component 90 is connected to the part $\mathbf{50}^{4'}$ so that the part $\mathbf{50}^{4'}$ moves relative thereto around a laterally extending axis $\mathbf{82}^{4'}$, which allows the part $\mathbf{50}^{4'}$ to pivot between the solid lines and dotted line positions, respectively representing first and second states for the armrest assembly $\mathbf{20}^{4'}$.

An appropriate mechanism 92 connects between the part $\mathbf{50}^{4'}$ and at least one of the riser component 90 and fixed frame base $\mathbf{44}^{4'}$ to allow automated changing of the state of the armrest assembly, permit user limb movement to effect this reconfiguration, effect locking, etc.

Figure 19:
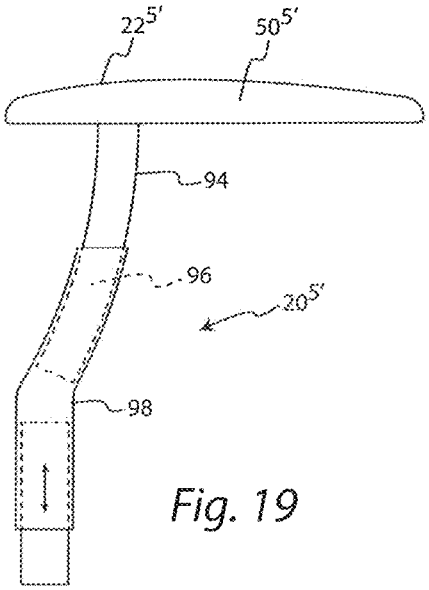
FIGS. 19 and 20 are side elevation views of a modified form of armrest assembly in first and second states, respectively.
Figure 20:
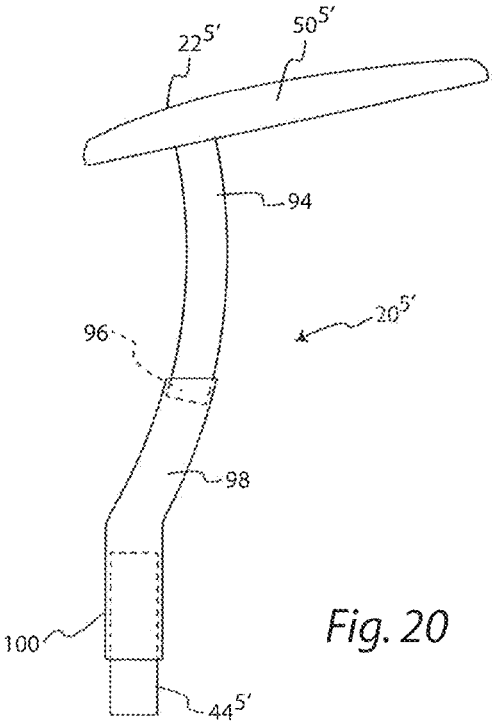

In FIGS. 19 and 20, a further modified form of armrest assembly, according to the present invention, is shown at $\mathbf{20}^{5'}$. The armrest assembly $\mathbf{20}^{5}$ has a part $\mathbf{50}^{5'}$, which defines the surface $\mathbf{22}^{5'}$, that is fixed to a guide piece 94. The guide piece 94 has a curved length, with the curvature thereof matched to the curvature of a passage 96 for the guide piece 94 defined by a support 98.

The support 98 has a bent shape with a lower portion 100 that cooperates with a fixed frame base $\mathbf{44}^{5'}$ to allow the support 98 to be moved guidingly upwardly and downwardly relative to the frame base $\mathbf{44}^{5'}$. As depicted, the lower part 100 and frame base $\mathbf{44}^{5'}$ make a telescoping connection. As with all such connections incorporated in any embodiments, the invention contemplates that the inside/outside relationship of telescoped components can be reversed.

In FIG. 19, the guide portion 94 is shown extended a predetermined amount into the passage 96, which represents a first state for the armrest assembly $\mathbf{20}^{5'}$. Because of the complementary curvatures of the guide portion 94 and passage 96, upward movement of the guide portion 94 relative to the support 98 causes the part $\mathbf{50}^{5'}$ to incline from rear to front until the corresponding second state for the armrest assembly $\mathbf{20}^{5'}$, as shown in FIG. 20, is achieved.

Figure 21:
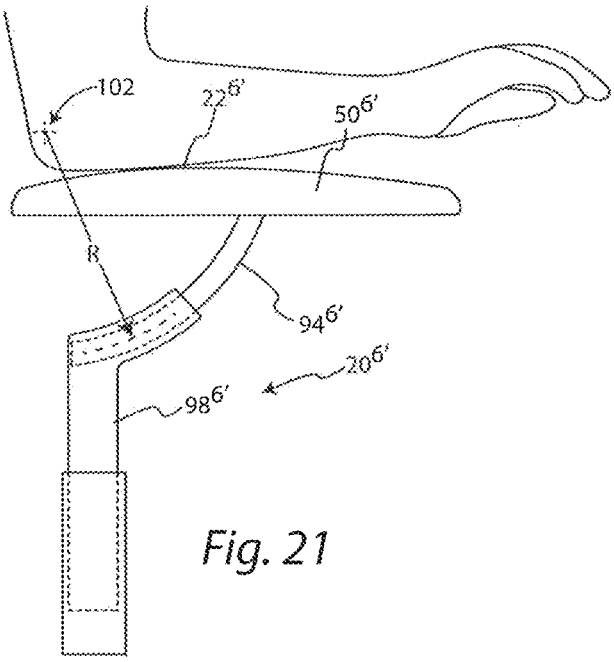
FIGS. 21 and 22 are side elevation views of a further modified form of armrest assembly in first and second states, respectively.
Figure 22:
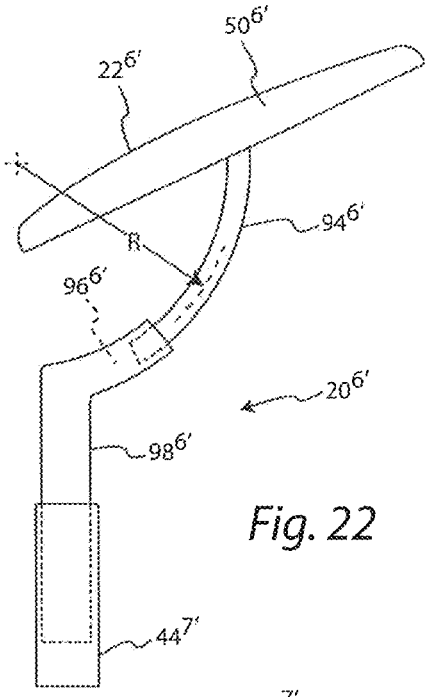

FIGS. 21 and 22 show an armrest assembly at $\mathbf{20}^{6'}$ that is a refinement of the more generic version shown in FIGS. 19 and 20 for the armrest assembly $\mathbf{20}^{5'}$ therein. The armrest assembly $\mathbf{20}^{6'}$ utilizes the same type of support $\mathbf{98}^{6'}$ that cooperates with a fixed frame base $\mathbf{44}^{6}$ and guide piece $\mathbf{94}^{6'}$ on a part $\mathbf{50}^{6'}$ that defines the armrest surface $\mathbf{22}^{6'}$.

In this embodiment, the curvatures of the passage $\mathbf{96}^{6'}$ and guide piece $\mathbf{94}^{6'}$ are approximated by an arc with a radius R that is centered at approximately the location of a user's elbow, indicated at 102, with the user in a sitting position. Thus, as a user, in a sitting position with his/her forearms resting on the surface $\mathbf{22}^{6'}$, bends his/her arm at the elbow, the part $\mathbf{50}^{6'}$ of the armrest assembly $\mathbf{20}^{6'}$ comfortably follows that path. That is, the surface $\mathbf{22}^{6'}$ follows the natural pivot path of a user's forearm as it hinges at the user's elbow.

Figure 23:
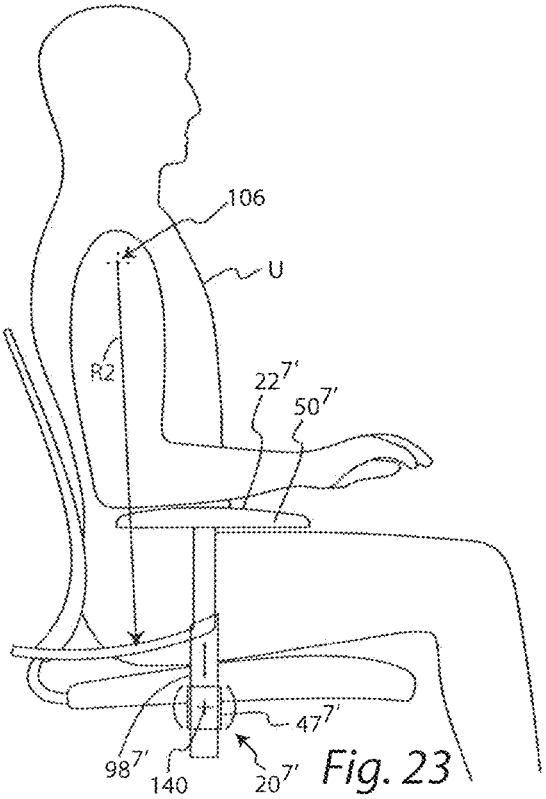
FIGS. 23 and 24 are side elevation views of a still further modified form of armrest assembly in first and second states, respectively.
Figure 24:
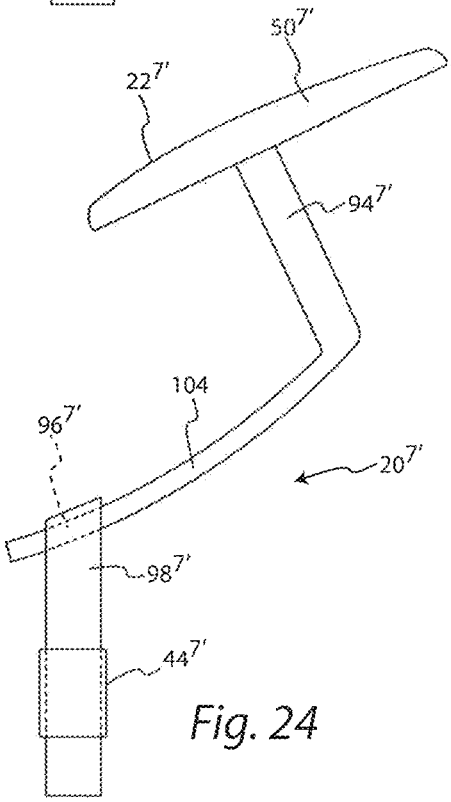

FIGS. 23 and 24 show a further modified form of armrest assembly at $\mathbf{20}^{7'}$ that has the same basic components as the armrest assembly $\mathbf{20}^{6'}$—notably, a support $\mathbf{98}^{7'}$ defining a curved passage $\mathbf{96}^{7'}$ that cooperates with both a fixed frame base $\mathbf{44}^{7'}$ and a guide piece $\mathbf{94}^{7'}$ with a part 104 having a curvature matched to that of the passage $\mathbf{96}^{7'}$.

The primary difference between the armrest assemblies $\mathbf{20}^{6'}$ and $\mathbf{20}^{7'}$ is that the curvature of the guide piece $\mathbf{94}^{7'}$ and that of the passage $\mathbf{96}^{7'}$ is greater than that for the corresponding parts on the armrest assembly $\mathbf{20}^{6'}$.

In a preferred form, the curvature of each of these components is approximated by an arc with a radius R2 centered approximately where a user's shoulder pivots with the user U in a sitting position, as shown in FIG. 23. This arc center location is indicated at 106. Accordingly, movement of the part $\mathbf{50}^{7'}$ defining the surface $\mathbf{22}^{7'}$ comfortably follows the pivoting movement of the entire arm of the user as it is repositioned while generally maintaining the bent shape shown in FIG. 23.

Essentially, for the armrest assemblies $\mathbf{20}^{6'}$ and $\mathbf{20}^{7'}$, the pivot axes for the parts $\mathbf{50}^{6'}$ and $\mathbf{50}^{7'}$ are moved from a location adjacent to the parts $\mathbf{50}^{6'}$ and $\mathbf{50}^{7'}$ to be at or adjacent elbow and shoulder joints for a user.

Figure 25:
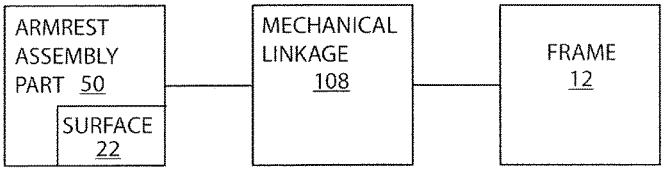
FIG. 25 is a schematic representation of a mechanical linkage connecting between an armrest assembly part, defining an arm resting surface, and a frame.

In FIG. 25, another generic type structure for connecting the exemplary arm assembly part 50, with the surface 22 thereon, to the fixed frame 12, is shown. The connecting structure is a mechanical linkage 108. This mechanical linkage 108 is part of the generic connecting structure 26 identified in FIG. 2. Specific exemplary forms of the mechanical linkage 108 will now be described, with it being understood that these are exemplary in nature only as virtually an unlimited number of different mechanical linkages might be devised that facilitate movement of the arm rest assembly part 50 relative to the frame 12 to change the associated armrest assembly between first and second states therefor.

Figure 26:
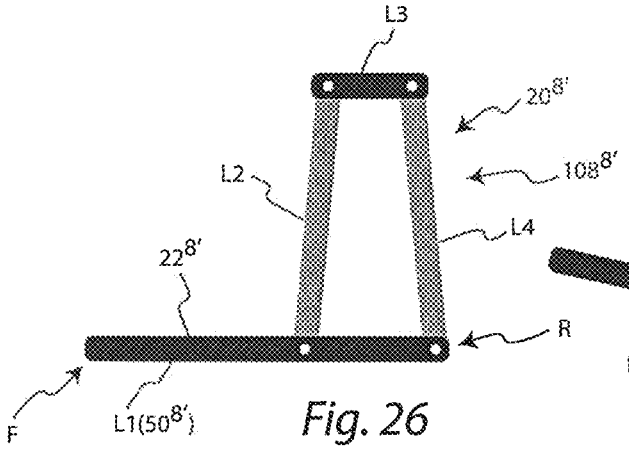
FIGS. 26 and 27 are schematic representations of a further modified form of armrest assembly incorporating one form of mechanical linkage, as in FIG. 25, and in first and second states, respectively.
Figure 27:
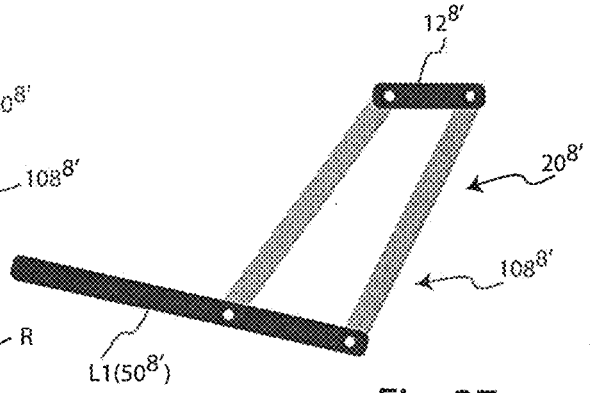

In FIGS. 26 and 27, an armrest assembly according to the present invention is shown at $\mathbf{20}^{8'}$ with one form of the mechanical linkage $\mathbf{108}^{8'}$ incorporated. While not required, this mechanical linkage uses four link members L1, L2, L3, L4, with the front and rear of the armrest assembly $\mathbf{20}^{8'}$ identified at F and R, respectively. The link members L1, L2, L3, L4 pivot where connected to each other about parallel axes extending into the page. The link member L1 is the part $\mathbf{50}^{8'}$ that defines the arm support surface $\mathbf{22}^{8'}$. The link member L3 is fixed to, or part of, the frame $\mathbf{12}^{8'}$.

Through this linkage arrangement, the link member L1 can be controllably repositioned to change the armrest assembly $20^{8'}$ between the FIG. 26 and FIG. 27 states, corresponding to the aforementioned first and second states therefor.

Changing of the states of the armrest assembly $20^{8'}$ can be effected by any means or mechanism herein described or mentioned.

Figure 28:
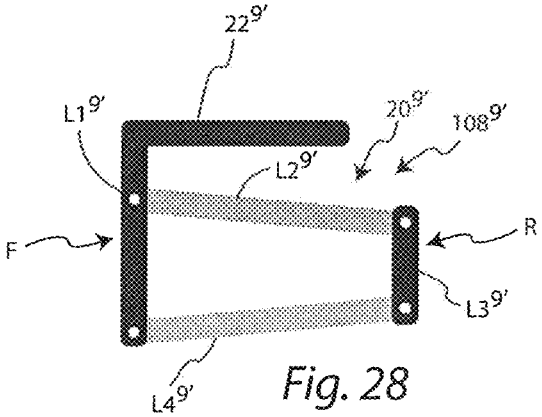
FIGS. 28 and 29 show a modified form of linkage similar to that in FIGS. 26 and 27 and in corresponding first and second states, respectively.
Figure 29:
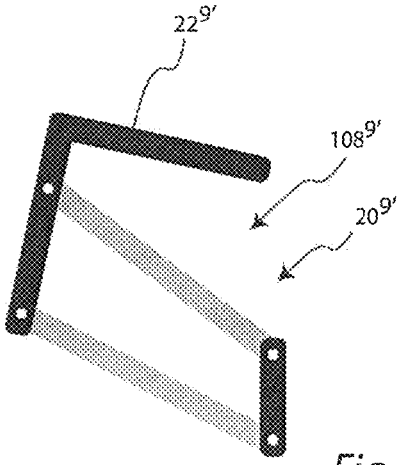

FIGS. 28 and 29 show a modified form of mechanical linkage $108^{9'}$ on an armrest assembly $20^{9'}$ with four link members $L1^{9'}$, $L2^{9'}$, $L3^{9'}$, $L4^{9'}$ corresponding to the link members L1, L2, L3, L4, successively on the armrest $108^{8'}$. The armrest assembly $20^{9'}$ has a front F and rear R.

The transverse orientation of the fixed link member $L3^{9'}$, compared to the corresponding link member L3, and the L-shaped configuration of the link member $L1^{9'}$, allow an inverted configuration for the link $L1^{9'}$ having the associated armrest surface $22^{9'}$.

Again, the linkage $108^{9'}$ allows changing of the armrest assembly $20^{9'}$ between first and second states as shown respectively in FIGS. 28 and 29.

Figure 30:
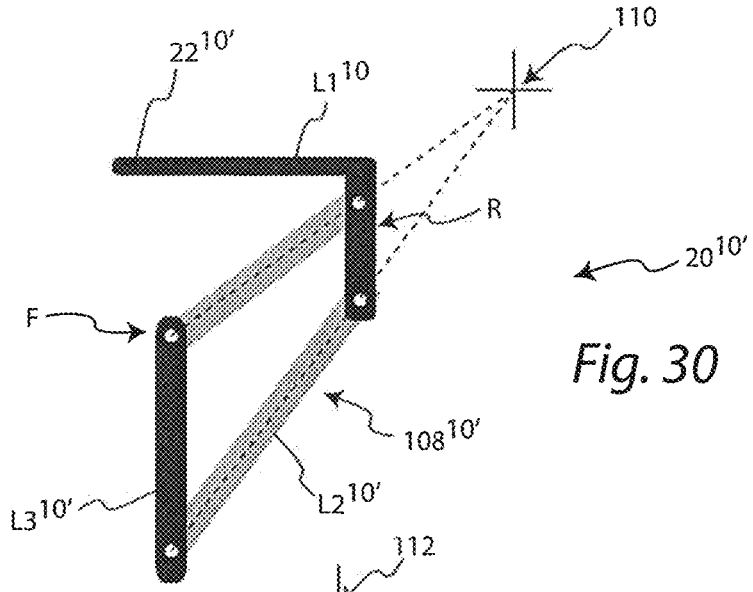
FIG. 30 is a further modified form of armrest assembly with a linkage as in FIGS. 26-29 in a first state and with a projected pivot coinciding with a sitting user's elbow.

FIG. 30 shows another modified form of armrest assembly $20^{10'}$ with a mechanical linkage $108^{11'}$ with four link members $L1^{10'}$, $L2^{10'}$, $L3^{10'}$, and $L4^{10'}$, with the operative orientation of the mechanical linkage $108^{10'}$ having a front and rear as identified at F and R.

The mechanical linkage $108^{10'}$ has a projected pivot location at 110 that corresponds to a user's elbow joint location with the user's arm resting on the surface $22^{10'}$.

Figure 31:
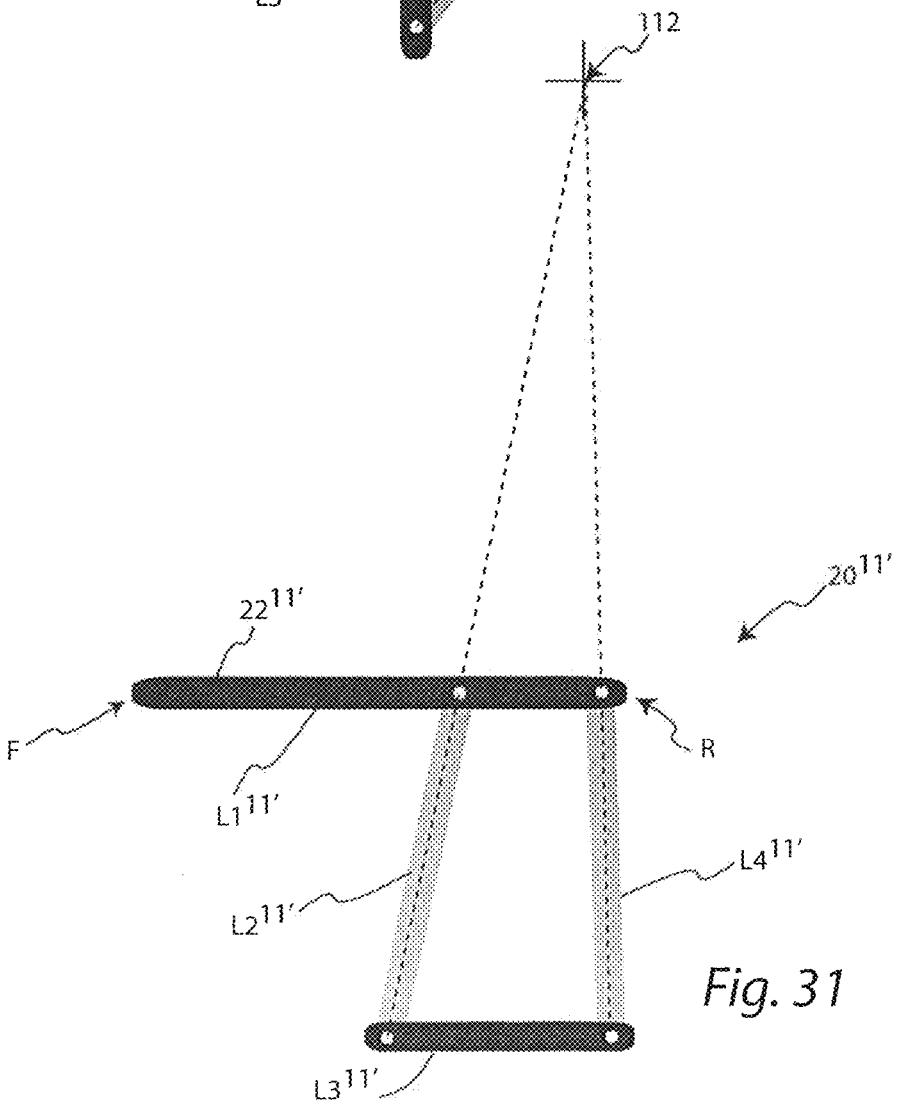
FIG. 31 is a view as in FIG. 30 wherein the armrest assembly has a projected pivot coinciding with a sitting user's shoulder.

FIG. 31 depicts a further modified form of armrest assembly $20^{11'}$ with a front F and rear R and corresponding link members $L1^{11'}$, $L2^{11'}$, $L3^{11'}$, and $L4^{11'}$ which cause the projected pivot location at 112 to reside at a user's shoulder joint with the user in a sitting position and having his/her arm resting on the surface $22^{11'}$.

In each of the embodiments in FIGS. 26-31, the part of the armrest assembly that defines each surface $22^{8'}$, $22^{9'}$, $22^{10'}$, $22^{11'}$ defines one of the link members. However, this is not a requirement.

Figure 32:
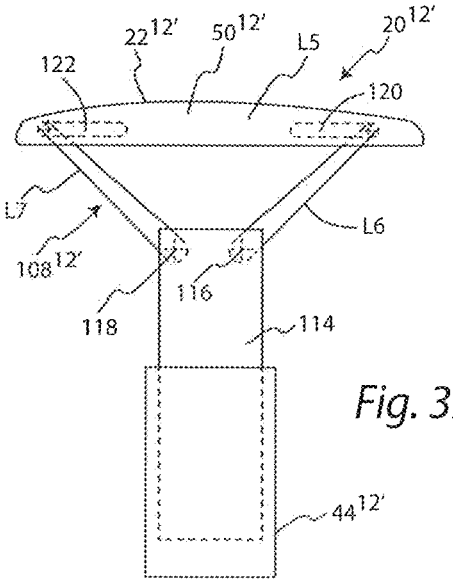
FIG. 32 is a side elevation view of a further modified form of armrest assembly incorporating a mechanical linkage.

FIG. 32 discloses a further modified form of armrest assembly at $20^{12'}$ with a part $50^{12'}$ defining a support surface $22^{12'}$. The part $50^{12'}$ is part of a mechanical linkage at $108^{12'}$ that is mounted on a support 114 that moves guidingly in a vertical direction relative to a fixed frame base $44^{12'}$.

The mechanical linkage $108^{12'}$ has three link members L5, L6, L7 with the link member L5 being the part $50^{12'}$ defining the surface $22^{12'}$. The link members L6, L7 each has an end connected to the support 114 for pivoting movement about laterally extending axes 116, 118, respectively. The opposite ends of the links L6, L7 move within horizontally elongate slots 120, 122, respectively on the part $50^{12'}$. The links L6, L7 are thus allowed to pivot and translate within the slots 120, 122, which thereby allows the surface $22^{12'}$ to be inclined from rear to front as in earlier embodiments. By this reconfiguration, the armrest assembly $20^{12'}$ is changed between corresponding first and second states. The part $50^{12'}$ moves without a fixed pivot axis. Essentially, it pivots and translates simultaneously as the armrest assembly $20^{12'}$ changes states. The armrest assembly $20^{12'}$ is front/rear neutral.

Figure 33:
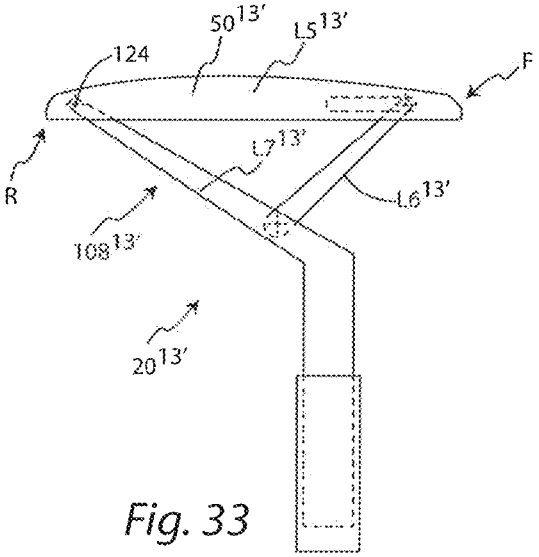
FIG. 33 is a side elevation view of a further modified form of armrest assembly including a modified form of mechanical linkage.

FIG. 33 shows an armrest assembly $20^{13'}$ with a front F and rear R and a mechanical linkage $108^{13'}$ with similarities to the mechanical linkage $108^{12'}$ in FIG. 31.

The mechanical linkage $108^{13'}$ has three link members $L5^{13'}$, $L6^{13'}$ and $L7^{13'}$.

In place of the slot 122, the part $50^{13'}$ has a pivot connection to the link member $L7^{13'}$ which allows the link members $L5^{13'}$, $L7^{13'}$ to move relative to each other around a fixed, laterally extending axis 124. This linkage arrangement allows reorientation of the part $50^{13'}$ to change the armrest assembly $20^{13'}$ between corresponding first and second states.

Both armrest assemblies $20^{12'}$ and $20^{13'}$ can be automatically or manually reconfigured by incorporating an appropriate mechanism and potentially separate actuating structure therefor.

Figures 34, 40, 41, 42, 43:
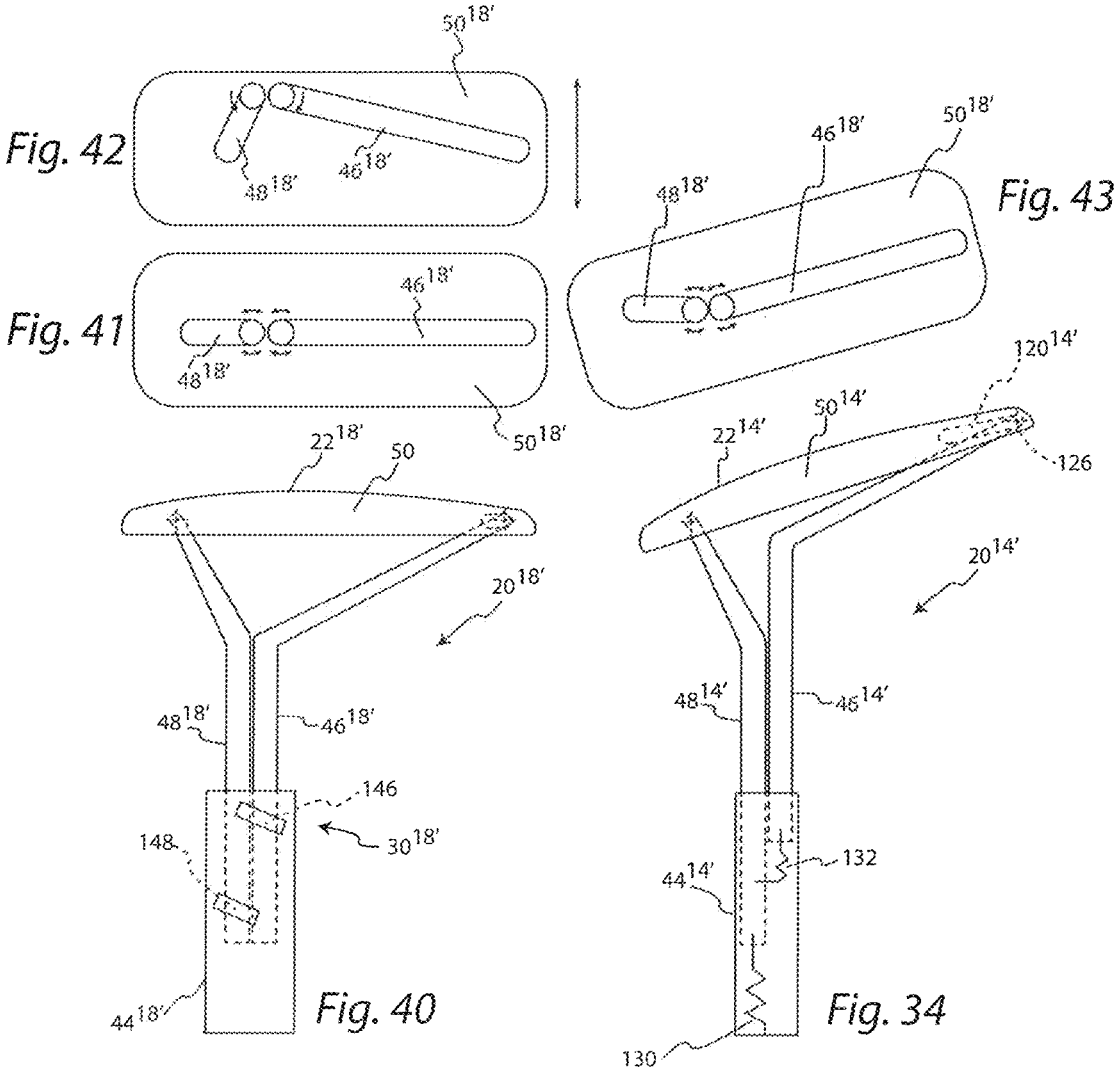
FIG. 34 is a side elevation view of a further modified form of armrest assembly with a spring assist.
FIG. 40 is a side elevation view of another form of armrest assembly with a specific form of locking assembly incorporated.
FIGS. 41-43 are underside schematic representations of riser components in FIG. 40 in different positions relative to a part on which the armrest surface is defined to place the arm support surface in different positions.

In FIG. 34, a further modified form of armrest assembly is shown at $20^{14'}$. The armrest assembly $20^{14'}$ has riser components $46^{14'}$, $48^{14'}$ that move vertically relative to each other to effect a change of state of the armrest assembly $20^{14'}$, as a result of a front inclination of the part $50^{14'}$ defining the armrest surface $22^{14'}$.

Rather than providing fixed pivot locations for the upper regions of the riser components $46^{14'}$, $48^{14'}$, the riser $46^{14'}$ has a component 126 that moves in an elongate slot $120^{14'}$. Thus, the upper end of the riser component $46^{14'}$ translates and pivots relative to the part $50^{14'}$ as the state of the armrest assembly $20^{14'}$ is changed.

In this embodiment, the riser component $48^{14'}$ is normally urged upwardly relative to a fixed frame base $44^{14'}$ by a biasing assembly shown schematically at 130. An additional biasing assembly 132 urges the riser component $46^{14'}$ upwardly relative to the riser component $48^{14'}$ so that the biasing forces provide a "spring assist" as the armrest assembly $20^{14'}$ is being changed into its second state, as depicted in FIG. 34.

This structure, among other things, potentially allows for a more comfortable transition between first and second states, regardless of how the transition is effected.

Figure 35:
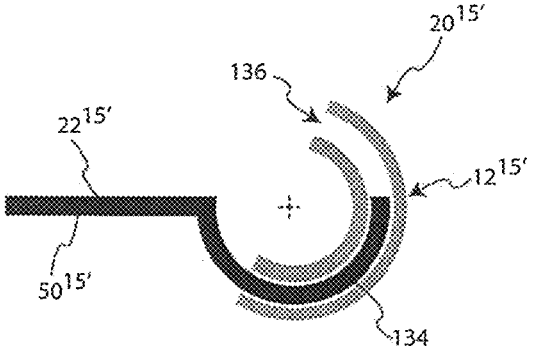
FIGS. 35 and 36 are schematic representations of a further modified form of armrest assembly in first and second states, respectively.
Figure 36:
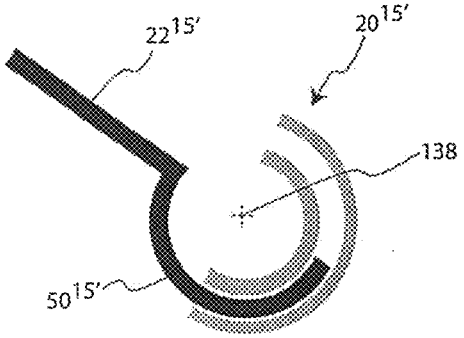

In FIGS. 35 and 36, a further modified form of armrest assembly is shown at $20^{15'}$. In this embodiment, a part $50^{15'}$, upon which the surface $22^{15'}$ is defined, has a guide portion 134 that moves in a track 136 that is on or part of the frame $12^{15}$. The guide portion 134 and track 136 have a complementary curved shape so that the part $50^{15'}$ is guided around a laterally extending axis 138. This movement allows the armrest assembly $20^{15'}$ to be changed between the first state in FIG. 35 and the second state in FIG. 36, corresponding to those same states for the various armrest assemblies discussed above.

The axis 138 may be located at, or adjacent, a user's elbow joint with the user in a sitting position.

Figure 37:
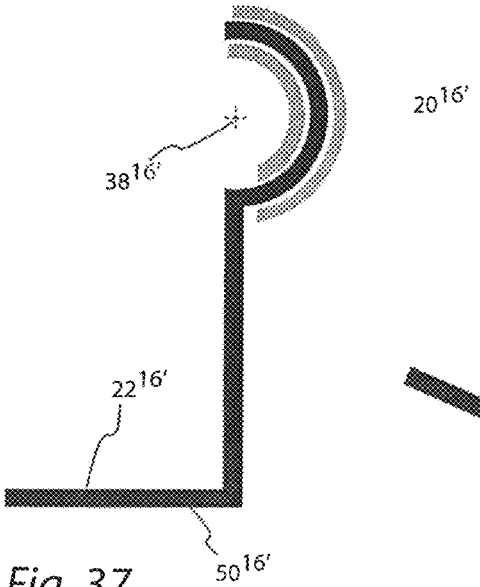
FIGS. 37 and 38 are schematic representations of a further modified form of armrest assembly, similar to that in FIGS. 35 and 36, in first and second states, respectively.
Figure 38:
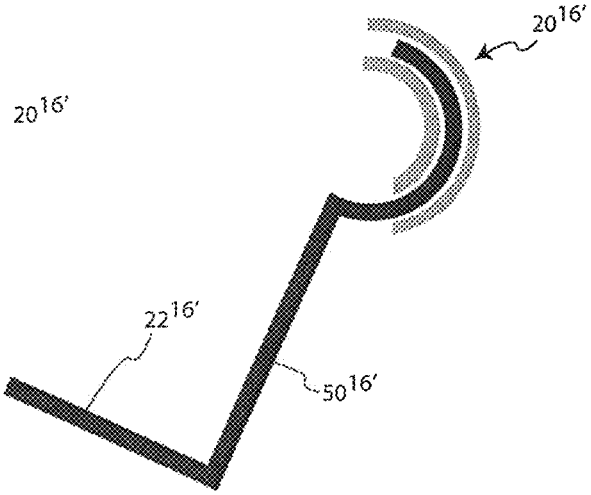

FIGS. 37 and 38 show a further alternative form of armrest assembly at $20^{16'}$, which utilizes the same basic structure, shown in FIGS. 35 and 36, to guide the part $50^{16'}$ with the surface $22^{16'}$ about an axis $138^{16'}$ to place the armrest assembly $20^{16'}$ in first and second states, respectively in FIGS. 37 and 38.

The armrest assembly $20^{16'}$ is preferably configured so that the axis $138^{16'}$ coincides with, or is adjacent to, a user's shoulder joint with the user in a sitting position.

This basic concept can be utilized with a number of different interacting components. For example, bearings might be utilized to guide relative movement between the components. Wheels could move in a track. A ball and socket, universal joint, or gimbal arrangement could be utilized. Virtually any type of structure that allows this guided movement of the parts $50^{15'}$, $50^{16'}$ is contemplated.

The invention contemplates variations of the above structures within the schematic showings thereof. For example, as shown in FIG. 23, the base $44^{7'}$, that is normally a fixed part of the frame, might be movable independently around a laterally extending axis 140 to provide, or augment, the inclination of the surface $22^{7'}$.

With the various embodiments described above, an adjusted position of the armrest surfaces may be maintained either by forces imparted by a user or through mechanical structure that may be operated by the user. The locking assembly/locking assemblies 30 that accomplish this, if manually operated, may utilize a dedicated actuator 32 or may be operated through manipulation of one or more basic components of the particular sitting apparatus that perform the function of a separate actuator.

Figure 39:
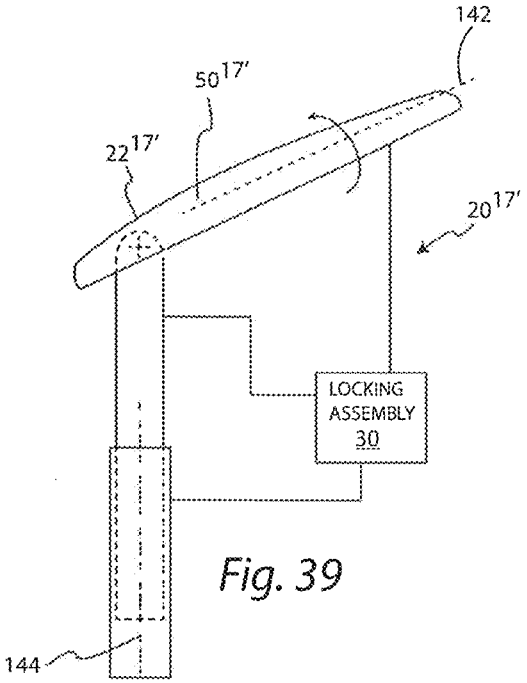
FIG. 39 is a side elevation view of an armrest assembly with a generic form of locking assembly to fix a desired position of the armrest support surface.

As one example, as shown schematically in FIG. 39, the locking assembly 30 on the generically depicted armrest assembly $\mathbf{20}^{17'}$ may be actuated by the part $\mathbf{50}^{17'}$, as by turning the part $\mathbf{50}^{17'}$ around its fore-and-aft/Y axis 142. The schematic showing is intended to encompass a locking assembly 30 that might be so actuated to fix the part $\mathbf{50}^{17'}$ against some or all of the potential movements permitted by the constructions described above—including front-to-rear/rear-to-front inclination, vertical shifting, pivoting about the vertical/Z axis 144, etc. This allows a user to effect locking of the part $\mathbf{50}^{17'}$ against one or more of the noted movements through the convenient manipulation of the part $\mathbf{50}^{17'}$. The turning of the part $\mathbf{50}^{17'}$ around the axis 142 is only one exemplary actuating movement.

Turning of the part $\mathbf{50}^{17'}$ around the axis 142 introduces the aspect that the part $\mathbf{50}^{17'}$ may have an additional degree of adjustment permissible through which the surface $\mathbf{22}^{17'}$ may be tipped from side to side.

Myriad different structures can be devised to effect locking of the surfaces 22 through the connecting structure 26, as shown schematically in FIG. 2.

As noted above, a discrete/dedicated actuator 32 might be provided and accessible to a user to operate the locking assembly 30.

In FIG. 40, an armrest assembly is shown at $\mathbf{20}^{18'}$ having an overall construction similar to the armrest assembly $\mathbf{20}^{14'}$ in FIG. 33. Grooves (not shown) may be provided on riser components $\mathbf{46}^{18'}$, $\mathbf{48}^{18'}$ to allow vertical/Z axis turning with respect to a fixed base $\mathbf{44}^{18'}$. Separate sprag clutches 146, 148 are provided to make up a locking assembly $\mathbf{30}^{18'}$.

The clutch 146 pivots at the riser component $\mathbf{48}^{18'}$. The clutch 148 pivots on the fixed base $\mathbf{44}^{18'}$.

As shown in FIGS. 41 and 42, the pivoting of riser components $\mathbf{46}^{18'}$, $\mathbf{48}^{18'}$, as shown in FIG. 40, allows different relationships to be set between the riser components $\mathbf{46}^{18'}$, $\mathbf{48}^{18'}$ and the part $\mathbf{50}^{18'}$ with which they are associated. Two exemplary relationships are shown in FIGS. 41 and 42. The result of changing the relationship of the part $\mathbf{50}^{18'}$ and riser components $\mathbf{46}^{18'}$, $\mathbf{48}^{18'}$ is that the lateral position of the part $\mathbf{50}^{18'}$ likewise changes. This function can be used to adjust spacing between the surfaces $\mathbf{22}^{18'}$ on the laterally spaced armrest assemblies $\mathbf{20}^{18'}$ on the particular sitting apparatus.

As seen in FIG. 43, this same pivoting of the riser components $\mathbf{46}^{18'}$, $\mathbf{48}^{18'}$ relative to the part $\mathbf{50}^{18'}$ may effect reorientation of the part $\mathbf{50}^{18'}$ around the vertical/Z axis.

Figure 44:
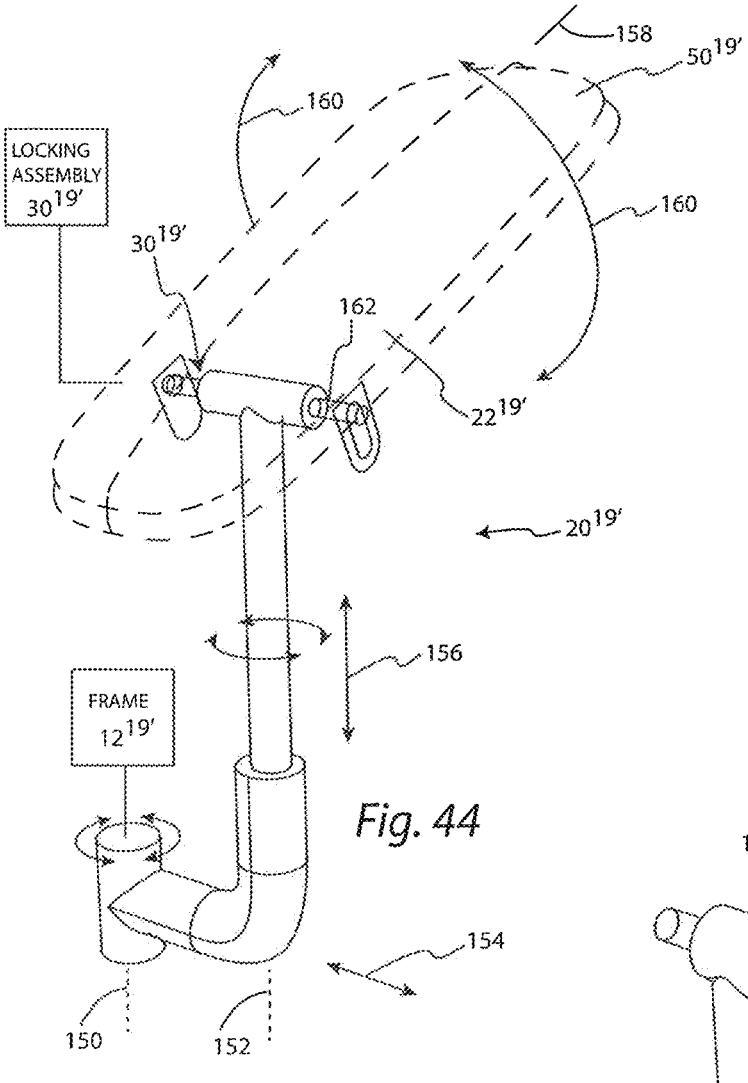
FIG. 44 is a partially schematic, perspective view of a modified form of armrest assembly with a locking assembly thereon.
Figure 45:
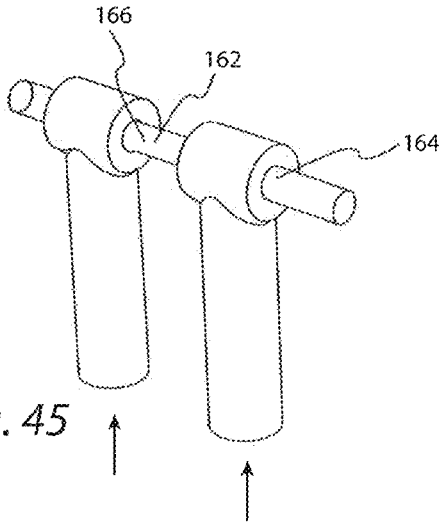
FIG. 45 is an enlarged, perspective view of a mounting system, for the part of the armrest assembly in FIG. 44 defining the arm support surface, that allows repositioning of the part of the armrest assembly to operate a locking assembly thereon.

FIGS. 44 and 45 show a still further embodiment of the inventive armrest assembly $\mathbf{20}^{19'}$ that is configured to allow the surface $\mathbf{22}^{19'}$ on the part $\mathbf{50}^{19'}$ to be repositioned relative to the frame $\mathbf{12}^{19'}$ by movement: a) selectively around separate Z axes 150, 152; b) along a horizontal axis, as indicated by the double-headed arrow 154; and c) vertically along the axis 152, as indicated by the double-headed arrow 156.

The locking assembly $\mathbf{30}^{19'}$ is designed to be operated by turning of the part $\mathbf{50}^{19'}$ around the Y axis 158, as indicated by the arrows 160. The locking assembly $\mathbf{30}^{19'}$ includes a rod 162 with ends 164, 166 supported for a gimbal-like motion that allows the tilting around the axis 158 through manipulation of the part $\mathbf{50}^{19'}$ to thereby actuate the other components making up the locking assembly $\mathbf{30}^{19'}$ to fix the surface $\mathbf{22}^{19'}$ against movement in one or more manners.

Generally, it should be understood that the various components and functions from the different embodiments described above are contemplated to be interchanged to provide additional versatility.

The invention is also contemplated to be used with sitting apparatus having all known types of structures to change orientations and positions of arm supporting surfaces on armrest assemblies.

The particular mechanisms utilized may be incorporated at least partially within certain components on existing chair technology. Alternatively, the structure can be independently constructed and added to the conventional components.

While the second state for the various surfaces 22 is described as inclined at a forward end thereof, opposite inclination is also contemplated.

If the actuator for the locking assembly is an existing component, it is not limited to the tilting of the part 50 about the Z axis. Any functional component on a sitting apparatus can be adapted to be an "actuator" through potentially relatively simple and convenient manipulation.

The foregoing disclosure of specific embodiments is intended to be illustrative of the broad concepts comprehended by the invention.

The invention claimed is:

1. A sitting apparatus comprising:

a frame configured to be situated at a sitting location;

a seat assembly on the frame defining a support for a user in a sitting position; and at least one armrest assembly having at least one surface to support an arm of a user in a sitting position on the seat assembly, the at least one armrest assembly configured to be changed between first and second states, the at least one surface changing in angular relationship to a horizontal reference plane as an incident of the at least one armrest assembly changing between the first and second states, wherein the at least one surface moves in an arc centered above the at least one surface as the at least one armrest assembly changes between the first and second states.

2. The sitting apparatus according to claim wherein the sitting apparatus has a front and rear and laterally spaced sides and the sitting apparatus is configured so that a lateral inclination of the at least one surface can be changed.

3. The sitting apparatus according to claim 1 wherein the sitting apparatus has a front and rear and laterally spaced sides and a front-to-rear inclination of the at least one surface changes as the at least one armrest assembly changes between the first and second states.

4. The sitting apparatus according to claim 3 wherein the armrest assembly is configured so that the at least one surface follows movement of a part of the at least one armrest assembly that pivots around a laterally extending axis at which the arc is centered as the at least one armrest assembly is changed between the first and second states.

5. The sitting apparatus according to claim 4 wherein the laterally extending axis is located at least approximately where a shoulder joint of a user in the sitting position is located.

6. The sitting apparatus according to claim 4 wherein the laterally extending axis is adjacent to the part of the at least one armrest assembly.

7. The sitting apparatus according to claim 4 wherein the part of the at least one armrest assembly is connected to the frame through a mechanical linkage comprising first and second relatively movable components.

8. The sitting apparatus according to claim 7 wherein the part of the at least one armrest assembly defines a link member in the mechanical linkage.

9. The sitting apparatus according to claim 7 wherein the mechanical linkage has a projected pivot located at least approximately where one of: a) a shoulder joint; and b) an elbow joint of a user in the sitting position is located.

10. The sitting apparatus according to claim 1 wherein the sitting apparatus further comprises a locking assembly that is operable to selectively maintain the at least one armrest assembly in at least one of the first and second states.

11. The sitting apparatus according to claim 10 wherein the locking assembly comprises an actuator that is configured to be moved by a user, the actuator comprising at least one of: a) a component that is movable independently of the at least one surface on the at least one armrest assembly; and b) a part of the at least one armrest assembly that moves with the at least one surface as the at least one armrest assembly is changed between the first and second states.

12. The sitting apparatus according to claim 1 wherein the at least one armrest assembly comprises first and second laterally spaced armrest assemblies.

13. The sitting apparatus according to claim 12 wherein the first and second armrest assemblies are configured so that the at least one surface on the first and second armrest assemblies can be relatively moved to change a lateral spacing between the at least one surface on the first and second armrest assemblies.

14. The sitting apparatus according to claim 12 wherein the first and second armrest assemblies are configured so that the at least one surface on each of the first and second armrest assemblies can be selectively raised and lowered relative to the frame.

15. The sitting apparatus according to claim 12 wherein the first and second armrest assemblies are configured so that the at least one surface on each of the first and second armrest assemblies can be selectively moved around a respective vertically extending axis.

16. The sitting apparatus according to claim 1 wherein the sitting apparatus further comprises a backrest that is configured to be moved relative to the frame so as to thereby change an angular orientation of the backrest relative to the frame.

17. The sitting apparatus according to claim 1 wherein the sitting apparatus further comprises a wheeled support for the frame.

18. The sitting apparatus according to claim 4 wherein the laterally extending axis is located at least approximately where an elbow joint of a user in the sitting position is located.

19. A sitting apparatus comprising:

a frame configured to be situated at a sitting location;

a seat assembly on the frame defining a support for a user in a sitting position; and at least one armrest assembly having at least one surface to support an arm of a user in a sitting position on the seat assembly, the at least one armrest assembly configured to be changed between first and second states, the at least one surface changing in angular relationship to a horizontal reference plane as an incident of the at least one armrest assembly changing between the first and second states, wherein the at least one surface moves in an arc centered approximately at a height of the one surface.

20. A sitting apparatus comprising:

a frame configured to be situated at a sitting location;

a seat assembly on the frame defining a support for a user in a sitting position; and at least one armrest assembly having at least one surface to support an arm of a user in a sitting position on the seat assembly, the at least one armrest assembly configured to be changed between first and second states, the at least one surface changing in angular relationship to a horizontal reference plane as an incident of the at least one armrest assembly changing between the first and second states, the armrest assembly comprising a linkage with relatively movable link members that connect to each other and a part of the at least one armrest assembly that moves as one piece with the at least one surface for relative movement around four substantially parallel axes so that the linkage has a projecting pivot location around which the at least one surface moves in an arcuate path as the at least one armrest assembly is changed between the first and second states.

21. The sitting apparatus of claim 20 wherein the projecting pivot location is generally at or below a shoulder joint of a user in a sitting position on the sitting apparatus as the at least one armrest assembly changes between the first and second states.

* * * * *